US005079781A

United States Patent [19]

Gnauert et al.

[11] Patent Number: 5,079,781

[45] Date of Patent: Jan. 14, 1992

[54] BACKFLOW PREVENTER FOR HAND SPRAY

[75] Inventors: Werner Gnauert, Iserlohn; Hans-Jürgen Jensen, Welver-Scheidingen, both of Fed. Rep. of Germany

[73] Assignee: Friedrich Grohe Armaturenfabrik GmbH & Co., Hemer, Fed. Rep. of Germany

[21] Appl. No.: 651,433

[22] Filed: Feb. 5, 1991

[30] Foreign Application Priority Data

Feb. 5, 1990 [DE] Fed. Rep. of Germany ..... 4003353
May 10, 1990 [DE] Fed. Rep. of Germany ..... 4014968

[51] Int. Cl.[5] ..... E03C 1/10
[52] U.S. Cl. ..... 4/192; 4/195; 137/218; 137/312
[58] Field of Search ..... 137/218, 312; 4/191, 4/192, 195

[56] References Cited

U.S. PATENT DOCUMENTS

| | | | |
|---|---|---|---|
| Re. 26,235 | 7/1967 | Woodford | 137/218 |
| Re. 29,332 | 8/1977 | Bilbro et al. | 165/164 |
| 2,219,259 | 10/1940 | Horn et al. | |
| 2,324,084 | 7/1943 | Horner | 137/218 |
| 2,472,933 | 6/1949 | Anderson | 137/218 |
| 2,608,412 | 8/1952 | Bletcher et al. | 137/218 X |
| 3,331,946 | 7/1967 | Bilbro | 219/535 |
| 3,903,916 | 9/1975 | Waletzko | 137/312 |
| 4,123,837 | 11/1978 | Horner | 165/164 |
| 4,203,186 | 5/1980 | Horner | 165/164 |
| 4,827,538 | 5/1989 | Heimann et al. | 137/217 X |
| 4,977,920 | 12/1990 | Oberdorfer | 137/218 |
| 5,009,247 | 4/1991 | Oberdorfer | 137/218 |

FOREIGN PATENT DOCUMENTS

| | | | |
|---|---|---|---|
| 3708169 | 9/1988 | Fed. Rep. of Germany . | |
| 8905206 | 8/1989 | Fed. Rep. of Germany . | |
| 3812549 | 10/1989 | Fed. Rep. of Germany . | |
| 8908214 | 10/1989 | Fed. Rep. of Germany . | |
| 2011584 | 7/1979 | United Kingdom . | |
| 2039345 | 8/1980 | United Kingdom | 137/218 |

OTHER PUBLICATIONS

Advertisement for Molded Foam Insulators, Bisco Products, Inc., undated.

*Primary Examiner*—Gerald A. Michalsky
*Attorney, Agent, or Firm*—Herbert Dubno; Andrew Wilford

[57] ABSTRACT

A backflow preventer used in combination with a plumbing fixture has a pressurizable supply line, an output hose that can be equipped with a sprayer or shower, and a drain. It further has a valve casing having an inlet valve seat forming an inlet port connected to the supply line, a vent valve seat forming a vent port opening to the atmosphere, and an outlet port opening laterally between the seats and connected to the supply hose. A valve body is movable in the casing between a normal-flow position on the vent seat blocking the vent and permitting flow between the inlet and outlet ports and a backflow-preventing position on the inlet seat blocking the inlet port and permitting flow between the outlet and vent ports. A spring or the like biases the valve body toward the inlet seat into the backflow-preventing position with a pressure sufficient to overcome atmospheric pressure at the inlet port so as to permit movement of the valve body into the normal-flow position when pressure at the inlet port substantially exceeds atmospheric pressure.

13 Claims, 4 Drawing Sheets

BACKFLOW PREVENTER FOR HAND SPRAY

FIELD OF THE INVENTION

The present invention relates to a backflow preventer. More particularly this invention concerns such a device used to prevent a hand sprayer or shower from drawing back liquid when feed pressure fails.

BACKGROUND OF THE INVENTION

A backflow-preventing valve is required in many jurisdictions when a plumbing fixture is connected to a normally pressurized line, in particular when used with a sprayer or hand shower that could be immersed in a body of dirty water when the supply pressure fails The backflow preventer has a high-pressure port connected to the normally pressurized service or supply line, a low-pressure port connected to the fixture, and a vent port. The high- and low-pressure ports are connected together and the vent port is blocked so long as pressure at the high-pressure port is higher than that at the low-pressure port. When, for instance due to a water-main failure or a rupture in the supply line at a lower elevation, pressure in the service line drops below that in the fixture or below atmospheric, the backflow preventer connects the high-pressure port to the vent port so that air, not the water in the fixture is drawn in. The device also frequently vents the low-pressure side of the device.

Such a device is built right into the faucet seen in commonly owned U.S. Pat. No. 4,827,538 of B Heimann et al. Here the vent valve is provided immediately downstream of a mixing valve whose upstream side is connected to incoming hot- and cold-water supply lines Any modest superatmospheric pressure at the vent valve will maintain it closed, but when pressure drops too low it opens the downstream side of the mixing valve to the atmosphere.

Such an arrangement has two main disadvantages. First of all it adds somewhat to the bulk of the fixture. Designing around this extra element is difficult since it must take up some room at a critical area, particularly in a deck-mount fixture. Second it is not required in all jurisdictions, so that valves sold in these regions either are equipped with unnecessary structure that needlessly raises the valve cost, a plug is substituted for the valve, or a second version of the valve without the vent device must be produced.

It is also known from German patent document 3,708,169 to provide a backflow preventer as a separate device having high-pressure, low-pressure, and vent ports and provided with an internal accordion-pleated tube that when internally pressurized directly connects the high-pressure port with the low-pressure port. When depressurized it retracts and opens both ports to the vent port. Such an arrangement shares with the system described above the disadvantage that in the backflow-preventing position all of the ports are interconnected. While this in theory will prevent the inlet port from sucking liquid in from the outlet port, it is technically possible for the entire housing of the valve to become flooded so that indeed some liquid does flow back into the inlet port. Thus a main disadvantage of this system is that if it is mounted below the liquid level, for instance, of a sink it will not work properly, as backflow can completely flood it.

OBJECTS OF THE INVENTION

It is therefore an object of the present invention to provide an improved backflow preventer.

Another object is the provision of such an improved backflow preventer which overcomes the above-given disadvantages, that is which does not make design of the faucet difficult, but that does positively block flow back into the supply line in the event of pressure reversal.

SUMMARY OF THE INVENTION

The instant invention is a backflow preventer used in combination with a plumbing fixture having a pressurizable supply line, an output hose that can be equipped with a sprayer or shower, and a drain. The backflow preventer has a valve casing having an inlet valve seat forming an inlet port connected to the supply line, a vent valve seat forming a vent port opening to the atmosphere, and an outlet port opening laterally between the seats and connected to the supply hose. A valve body is movable in the casing between a normal-flow position on the vent seat blocking the vent and permitting flow between the inlet and outlet ports and a backflow-preventing position on the inlet seat blocking the inlet port and permitting flow between the outlet and vent ports. A spring or the like biases the valve body toward the inlet seat into the backflow-preventing position with a pressure sufficient to overcome atmospheric pressure at the inlet port so as to force the valve body into the normal-flow position when pressure at the inlet port substantially exceeds atmospheric pressure.

Thus with the system of this invention the backflow preventer can be provided below the liquid level of the fixture. The spring will ensure that the device works in this position where a prior-art system would flood and become ineffective. Furthermore when in the backflow-preventing position flow back into the supply line is totally blocked so that eve if the entire valve floods there will be no backflow, the inlet port is blocked in a sort of check-valve operation.

According to another feature of this invention a second such casing, body, and biasing spring are provided immediately adjacent the first-mentioned casing, body, and biasing unit The second casing has an inlet port connected to the outlet port of the first casing and an outlet port connected to the outlet fitting. The outlet port of the first casing is above the inlet seat of the second casing. The second valve not only adds a level of redundancy to further protect against any backflow, but any modest spray that could get back past the second downstream valve will not be able to get past the first one, ensuring very complete isolation of the supply line.

In accordance with a further feature of the invention the inlet port opens vertically upward and the outlet port opens horizontally. Furthermore the preventer has a housing formed with an inlet fitting connected to the supply line, an output fitting connected to the output hose, a vent hole open to the atmosphere, and a drain fitting connected to the drain. Here the inlet and outlet ports are connected to the respective fittings. The fixture includes a mixing valve connected to and supplying water to the supply line.

Furthermore according to the invention a conduit connects the drain fitting to the drain and the drain includes a trap having upstream and downstream sides. The conduit is connected to the drain downstream of the trap and the backflow preventer further comprises a check valve in the conduit only permitting flow from the housing to the drain. This check valve is provided on the housing at an upstream end of the conduit and has a valve seat and therebelow a buoyant valve body The drain fitting is formed with a step forming the valve seat.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
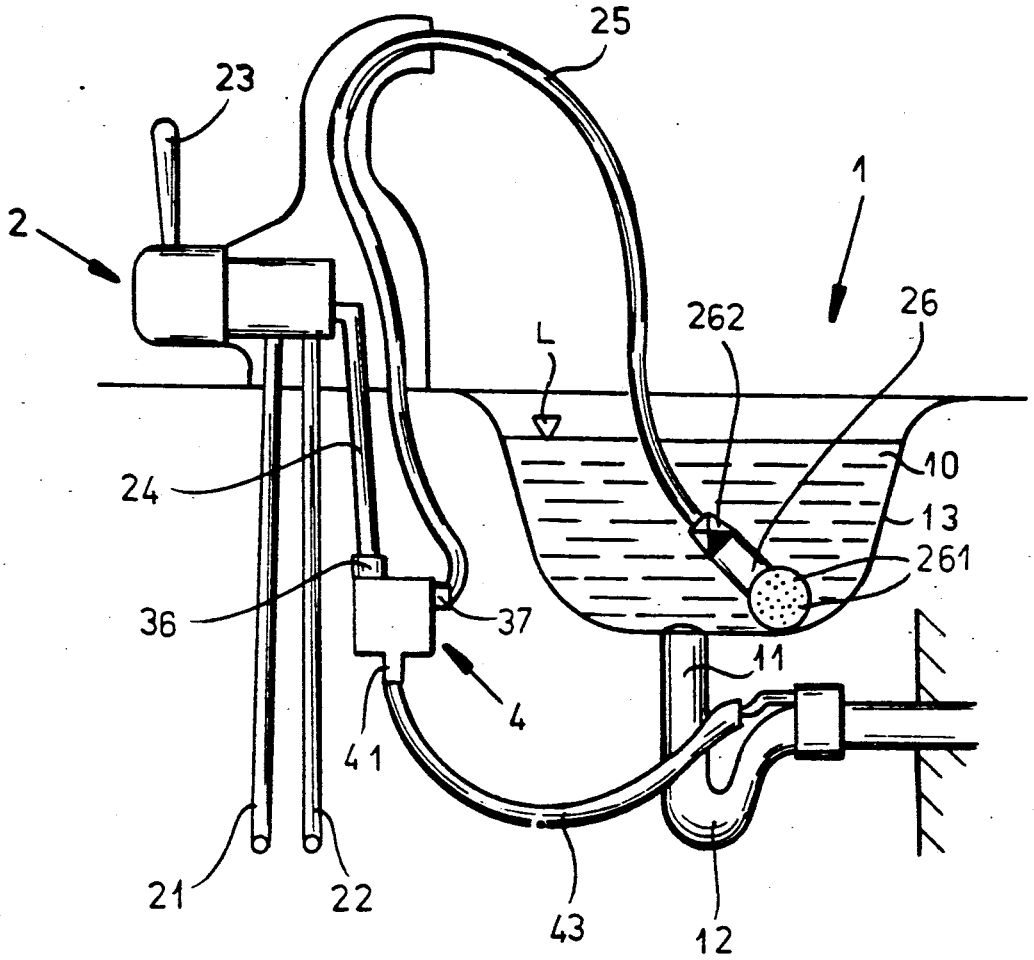
FIG. 1 is a highly diagrammatic illustration partly in vertical section showing the backflow preventer and plumbing fixture according to this invention.
Figure 2:
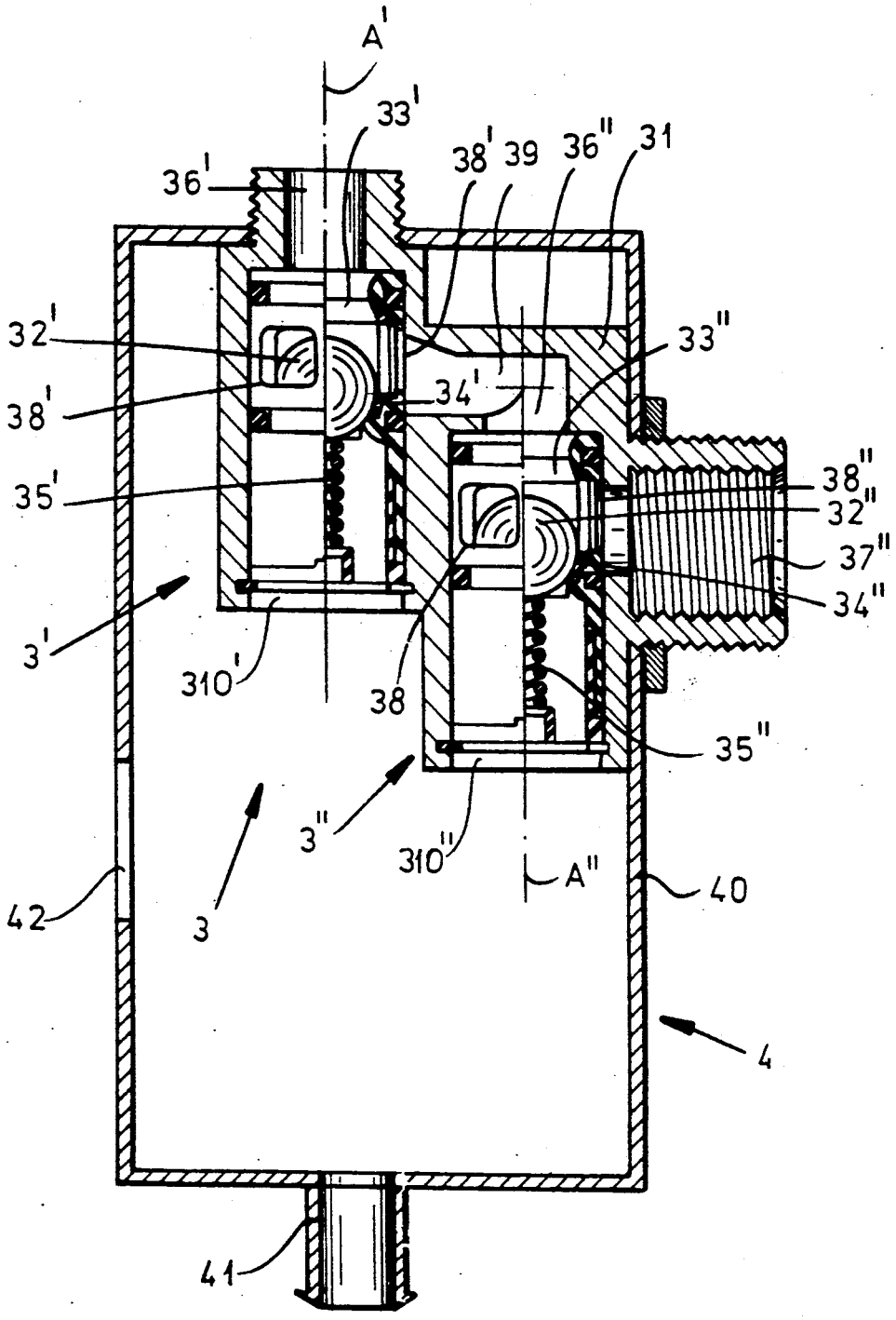
FIG. 2 is a larger-scale vertical section through the backflow preventer of FIG. 1.

As seen in FIGS. 1 and 2 a plumbing fixture 1 is provided with a mixing valve 2 and has a backflow preventer 4 in turn having a valve 3.

The fixture 1 includes a sink basin 13 filled with a body of water 10 having a liquid level L. The bottom of this sink 13 has a drain pipe 11 provided with a standard P trap 12.

The valve 2 is connected to pressurized hot- and cold-water inlet lines 21 and 22 and has an output supply line 24 connected to the preventer 4 to which it supplies hot, cold, or warm water. A lever 23 on the valve 2 is moved from side to side to determine the temperature of the water in the line 24 and from front to back to determine its pressure or flow rate. A hose 25 is connected through the preventer 4 to the line 24 and has on its output end a hand shower or sprayer 26 with outlet holes 261. This sprayer 26 may be provided with an internal check valve 262 that normally prohibits flow back u the hose 25.

As best seen in FIG. 2 the backflow preventer 4 has a housing 40 having one vertical side wall provided with a vent hole 42 and a floor formed with a drain fitting 41. A hose 43 is connected between the fitting 41 and the drain pipe 11 downstream of the trap 12. The size of the housing 40 prevents any vented liquid from tainting the valves 3' and 3" with bacteria.

Inside the housing 40 is the backflow preventer 3 comprised of two substantially identical valves 3' and 3" having a common casing 31. The valve 3' has an inlet port 36' forming an inlet fitting connected to the tubing 24 and the valve 3" has a laterally opening outlet port 37" forming an outlet fitting connected to the hose 25. The valve 3' further has a laterally opening outlet port 38' connected via an L-shaped passage 39 to the inlet port 36" of the valve 3" and the valves 3' and 3" have downwardly open vent ports 310' and 310" aligned directly under their inlet ports 36' and 36" along respective vertical axes A' and A". The valves 3' and 3" are formed around their inlet ports 36' and 36" with inlet seats 33' and 33" and therebelow but above their vent ports 310' and 310" with vent seats 34' and 34". Furthermore the valves 3' and 3" are provided with cages or baskets 38' and 38" holding respective valve balls 32' and 32" that are urged upward with slight force by respective biasing springs 35' and 35". The force of the springs 35' and 35" is such that the respective balls 32' are pushed up into the inlet seats 33' and 33" whenever pressure in the respective inlet ports 36' and 36" drops below a slightly superatmospheric level.

Thus so long as the pressure in the line 24 is somewhat above atmospheric pressure the bodies 32' and 32" will be pushed down into the seats 34' and 34", blocking the respective vent ports 310' and 310" and permitting flow from the inlet port 36' to the outlet port 37" and, hence, from the supply line 24 to the hose 25.

Assuming, however, the sprayer 26 is dropped in the body 10, its valve 262 fails, and the input pressure in the line 24 drops precipitously below atmospheric, the springs 35' and 35" will sequentially push the balls 32' and 32" up into the seats 33' and 33", thereby closing the inlet ports 33' and 33" and thereby absolutely blocking any flow back upstream into the line 24. In addition in this position the outlet port 37" is open to the vent port 310" so that any backflow will drain into the housing 40 and through the drain hose 43 to the drain 11. Even if the hose 43 gets stopped up, liquid in the housing 40 will flow out the hole 42 and will not be sucked back up into either of the vents 310' or 310" which both according to this invention are above the level of at least the lower edge of the hole 42.

When supply pressure is subsequently restored, the balls 32' and 32" will be sequentially pushed axially back down onto the seats 34' and 34", thereby restoring the connection to the hose 25 which will be flushed out with clean water.

Figure 3:
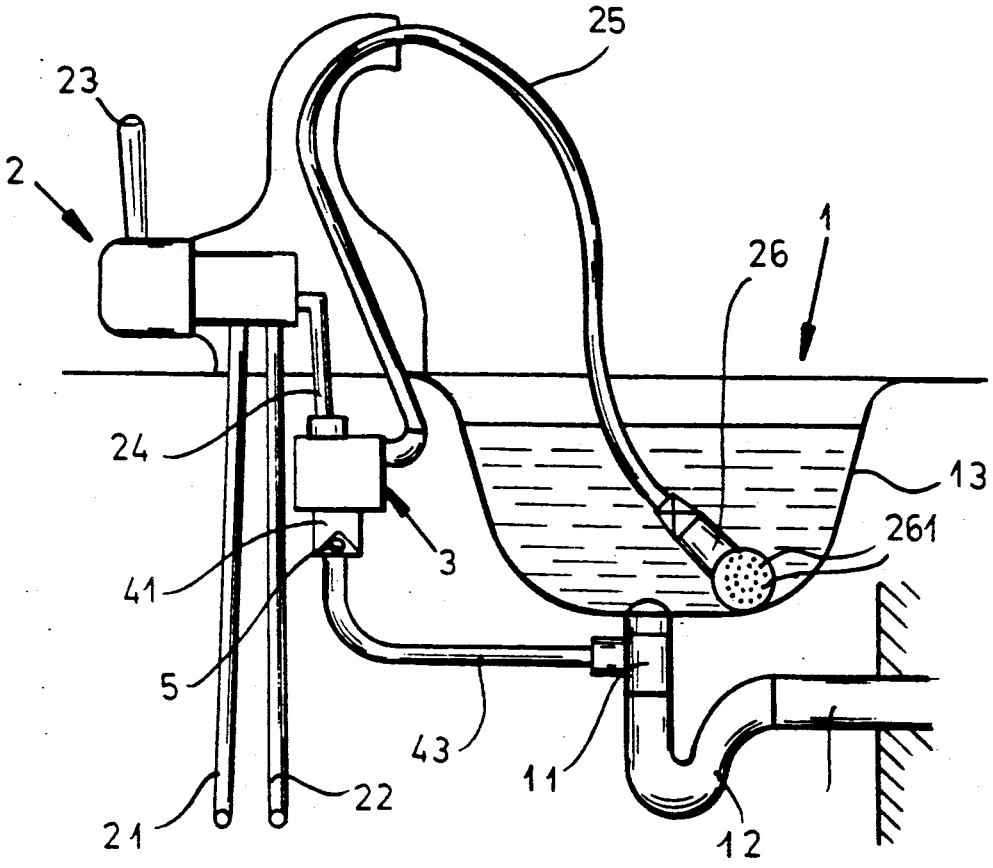
FIGS. 3 and 4 are views like FIGS. 1 and 2, respectively, showing another arrangement according to the invention.
Figure 4:
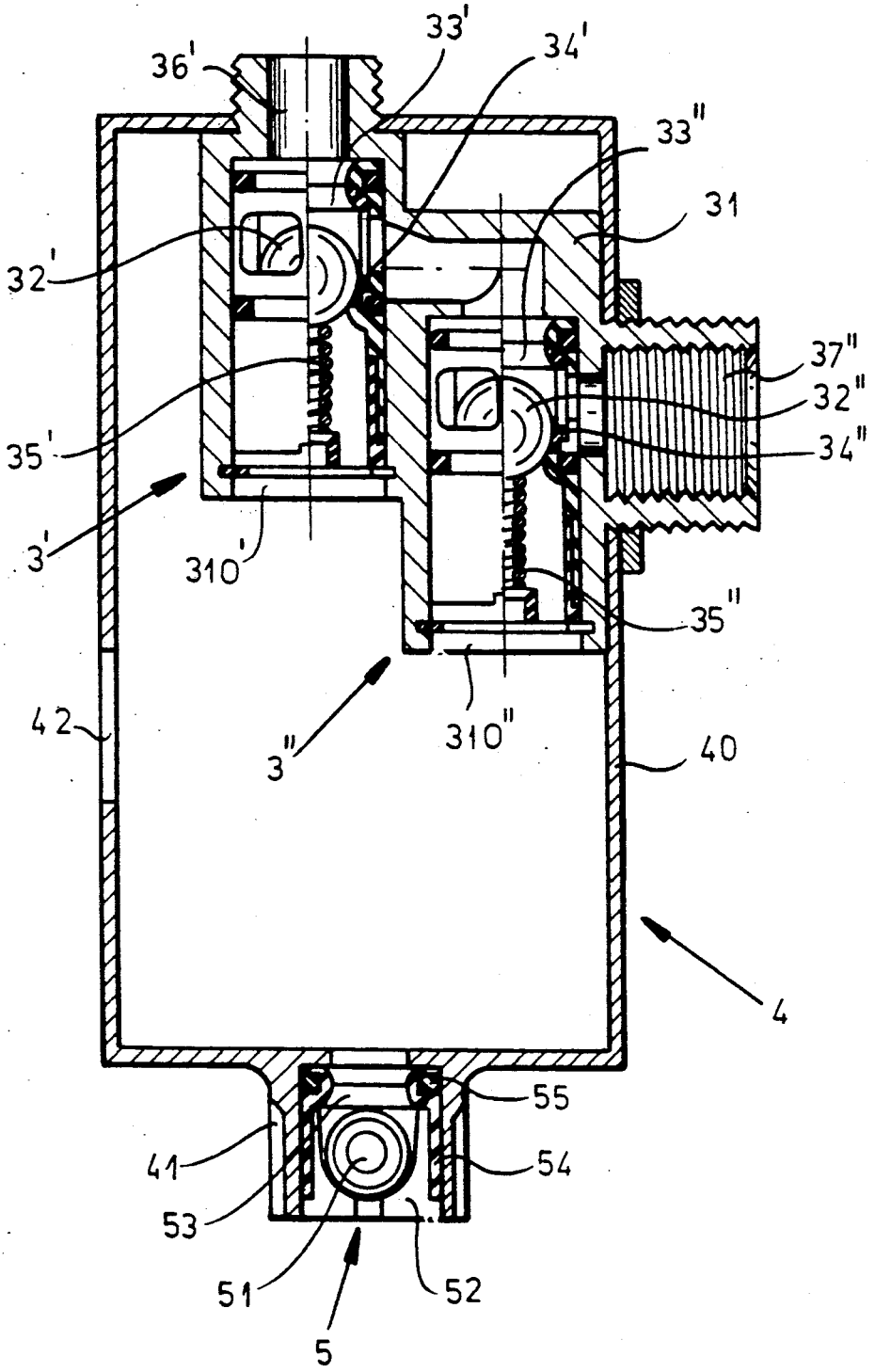

The system of FIGS. 3 and 4 functions similarly to that of FIGS. 1 and 2 and functionally and/or structurally identical elements bear the same reference numerals as in FIGS. 1 and 2. Here the drain fitting 41 is provided with a check valve 5 and the drain hose 43 is connected to the drain pipe 11 upstream of the trap 12. This valve 5 therefore prevents liquid in the sink 11 from backing up through the line 43 into the housing 40.

The fitting itself is provided with a basket 52 containing a buoyant float ball 51 that can move up against a seat 53 provided with a seal ring 55. Thus if water backs up in the line 43 the ball 51 will float up and block the seat 53, thereby closing off the drain fitting 41.

We claim:

1. In combination with a plumbing fixture having a vessel capable of containing a body of water having a liquid level;

a pressurizable supply line;

an output hose; and a drain, a backflow preventer comprising:

a valve casing below the liquid level and having an inlet valve seat forming an inlet port connected to the supply line, a vent valve seat forming a vent port opening to the atmosphere, and an outlet port opening laterally between the seats and connected to the supply hose;

a valve body in the casing movable between a normal-flow position on the vent seat blocking the vent and permitting flow between the inlet and outlet ports and a backflow-preventing position on the inlet seat blocking the inlet port and permitting flow between the outlet and vent ports; and biasing means urging the valve body toward the inlet seat into the backflow-preventing position with a pressure sufficient to overcome atmospheric pressure at the inlet port and for permitting movement of the valve body into the normal-flow position when pressure at the inlet port substantially exceeds atmospheric pressure.

2. The backflow preventer defined in claim 1, further comprising a second such casing, body, and biasing means immediately adjacent the first-mentioned casing, body, and biasing means, the second casing having an inlet port connected to the outlet port of the first casing and an outlet port connected to the outlet fitting.

3. The backflow preventer defined in claim 2 wherein the outlet port of the first casing is above the inlet seat of the second casing.

4. The backflow preventer defined in claim 1 wherein the biasing means is a spring.

5. The backflow preventer defined in claim 1 wherein the inlet port opens vertically upward, the outlet port opens horizontally.

6. The backflow preventer defined in claim 1, further comprising:

a housing formed with an inlet fitting connected to the supply line, an output fitting connected to the output hose, a vent hole open to the atmosphere, and a drain fitting connected to the drain, the inlet and outlet ports being connected to the respective fittings.

7. The backflow preventer defined in claim 6 wherein the fixture further comprises a mixing valve connected to and supplying water to the supply line.

8. The backflow preventer defined in claim 6, further comprising a conduit connecting the drain fitting to the drain.

9. The backflow preventer defined in claim 8 wherein the drain includes a trap having upstream and downstream sides, the conduit being connected to the drain downstream of the trap, the backflow preventer further comprising a check valve in the conduit only permitting flow from the housing to the drain.

10. The backflow preventer defined in claim 9 wherein the check valve is provided on the housing at an upstream end of the conduit.

11. The backflow preventer defined in claim 10 wherein the check valve has a valve seat and therebelow a buoyant valve body.

12. The backflow preventer defined in claim 11 wherein the drain fitting is formed with a step forming the valve seat.

13. In combination with a plumbing fixture having a pressurizable supply line;

an output hose; and a drain, a backflow preventer comprising:

a housing formed with an inlet fitting connected to the supply line, an output fitting connected to the output hose, a vent hole open to the atmosphere, and a drain fitting connected to the drain and located below the vent hole;

a valve casing in the housing having an inlet valve seat forming an inlet port connected to the inlet fitting, a vent valve seat forming a vent port opening into the housing above the vent hole, and an outlet port opening laterally between the seats and connected to the outlet fitting;

a valve body in the casing movable between a normal-flow position on the vent seat blocking the vent port and permitting flow between the inlet and outlet ports and a backflow-preventing position on the inlet seat blocking the inlet port and permitting flow between the outlet and vent ports; and biasing means urging the valve body toward the inlet seat into the backflow-preventing position with a pressure sufficient to overcome atmospheric pressure at the inlet port and for permitting movement of the valve body into the normal-flow position when pressure at the inlet port substantially exceeds atmospheric pressure.

* * * * *